US005855218A

United States Patent [19]

Giannetti

[11] Patent Number: 5,855,218

[45] Date of Patent: Jan. 5, 1999

[54] SPRAY GUN CLEANING APPARATUS

[75] Inventor: Patrick J. Giannetti, Lake Angelus, Mich.

[73] Assignee: BASF Corporation, Southifeld, Mich.

[21] Appl. No.: 566,783

[22] Filed: Dec. 4, 1995

[51] Int. Cl.[6] ..... B08B 15/00

[52] U.S. Cl. ..... 134/102.1; 134/104.4; 134/169 C; 134/166 C; 134/109

[58] Field of Search ..... 134/100.1, 166 C, 134/168 C, 169 C, 102.1, 104.4, 109, 108

[56] References Cited

U.S. PATENT DOCUMENTS

| | | | |
|---|---|---|---|
| 2,569,125 | 9/1951 | Costantino | 134/109 |
| 4,819,677 | 4/1989 | Stern | 134/166 R |
| 4,823,820 | 4/1989 | Larson et al. | 134/108 |
| 4,827,955 | 5/1989 | Stern | 134/111 |
| 4,828,660 | 5/1989 | Clark et al. | 134/109 |
| 4,934,393 | 6/1990 | Lighthall et al. | 134/102.2 |
| 5,183,066 | 2/1993 | Heathcoat | 134/102.2 |
| 5,322,571 | 6/1994 | Plummer et al. | 134/102.1 |
| 5,549,128 | 8/1996 | Mansur | 134/108 |

*Primary Examiner*—Frankie L. Stinson
*Attorney, Agent, or Firm*—Anne Gerry Sabourin; Anna M. Budde

[57] ABSTRACT

A spray gun cleaning device for capturing and condensing cleaning solvent and a method for using. The spray gun cleaning device comprises:

(a) a passage way comprising an inlet and an outlet, wherein said inlet defines a receptacle for receiving a spray gun nozzle, (b) a vertically descending member having a proximal opening and first and second distal openings, wherein the first distal opening is located downstream from the proximal opening and at a 90° angle to the second distal opening, and wherein the descending member is connected to the passage way at its proximal opening, (c) a waste collection container located downstream of the vertically descending member, and connected to the first distal opening of the descending member, and (d) a vertically ascending passive condenser attached to the vertically descending member at its second distal opening, wherein the condenser comprises a multiplicity of tubular members located adjacent to one another.

20 Claims, 1 Drawing Sheet

510
512

41
10
40
16
14
12
18
42
36
21
3
3
20
38
4
4
34
23
32
26
24
22
44
30
25
28
46
212
210
216
214

310
312

410
412
414

SPRAY GUN CLEANING APPARATUS

BACKGROUND OF THE INVENTION

The present invention relates to equipment for reducing emissions during cleaning of air atomization spray guns for paint. More particularly, the invention concerns a device for capturing and condensing aspirated cleaning solvent that is sprayed from the spray gun during cleaning.

One common method of applying paint is by pneumatic spray equipment, such as a hand-held spray gun or pressure pot. Air atomization spray equipment produced a pattern of fine, uniform droplets. The paint is drawn up into the spray gun and forced out of an orifice in the spray gun nozzle. The nozzle comprises a fluid tip, having an orifice to deliver the paint, and an air cap that surrounds the fluid tip. The air cap delivers a pattern of atomization air around the discharged stream of paint. The paint is atomized by the pressurized streams of air impinging the paint from different points around the air cap, thereby breaking the paint stream into discrete paint droplets. The air cap also delivers jets of pattern shaping air against diametrically opposite sides of the atomized paint spray. Breaking the paint into spray droplets allows application of a smooth and even coating of paint onto the surface being coated.

Usually, the same equipment is used to apply any number of different paint formulations and colors consecutively onto different articles needing to be painted. The spray equipment must be cleaned before it is used for a different paint in order to prevent contamination of the new paint with the residue of the previous paint that is left in and on the spraygun. Such contamination could result in, for example, cratering of the coating if the two formulations are incompatible, or a color shift if the two formulations are different in color. Organic solvents are commonly used to clean out the spray gun and other spray equipment. The cleaning operation can be simply spraying solvent through the spray gun. Low molecular weight solvents such as acetone, methyl ethyl ketone, isopropyl alcohol, toluene, xylene, and butyl acetate, used alone or in combination, readily wash out the paint and also evaporate fast so that the equipment is clean and dry for application of the next paint.

A significant drawback to this simple procedure of spraying solvent through to clean out the spray gun is venting of the cleaning solvent to the atmosphere. Emissions of volatile organic compounds are rigorously controlled by both state and federal governments. Facility permits limit how much solvent can be emitted and require record keeping of all emissions of volatile organic compounds, whether as a specific permit condition or as a general need to show that the limits have been respected. In addition, some of the best cleaning solvents (methanol, methyl ethyl ketone, toluene, xylene, and ethylene glycol ethers) are further regulated as so-called hazardous air pollutants (HAP) under the Federal Clean Air Act. It would thus be advantageous to capture the sprayed cleaning solvent so as to prevent its release to the environment. Finally, if the cleaning solvent is captured and recondensed, it can be recycled, for instance by distilling it from the paint sludge and reusing it as cleaning solvent. Recycling the solvent instead of emitting it to the atmosphere thus has both ecological and economic benefits.

U.S. Pat. No. 4,934,393 to Lighthall et al. discloses an apparatus for condensing and collecting used cleaning solvent from cleaning a spray gun. The Lighthall apparatus requires a negative pressure generator connected to a source of compressed air. The negative pressure pulls the air through the filter condenser of the apparatus. Lighthall describes condensers as preferably containing fine mesh brass wool. In the preferred embodiment, the vapors are also condensed in concentric cylindrical passageways.

An alternative, passive spray gun cleaning apparatus, which operates by a simplified mechanism is desirable. It is this objective to which the present invention is directed.

SUMMARY OF THE INVENTION

The present invention comprises a spray gun cleaning device for capturing and condensing sprayed cleaning solvent from waste material which includes paint, paint sludge and solvent. The spray gun cleaning device comprises:

(a) a passage way comprising an inlet and an outlet, wherein said inlet defines a receptacle for receiving a spray gun nozzle, (b) a vertically descending member having a proximal opening and first and second distal openings, wherein the first distal opening is located downstream from the proximal opening and at a 90° angle to the second distal opening, and wherein the descending member is connected to the passage way at its proximal opening, (c) a waste collection container located downstream of, and connected to the first distal opening of the vertically descending member, (d) a vertically ascending passive condenser connected to the vertically descending member at its second distal opening, wherein the condenser comprises a multiplicity of tubular members located adjacent to one another.

DETAILED DESCRIPTION OF THE INVENTION

Figures 1, 2, 3, 4, 5:
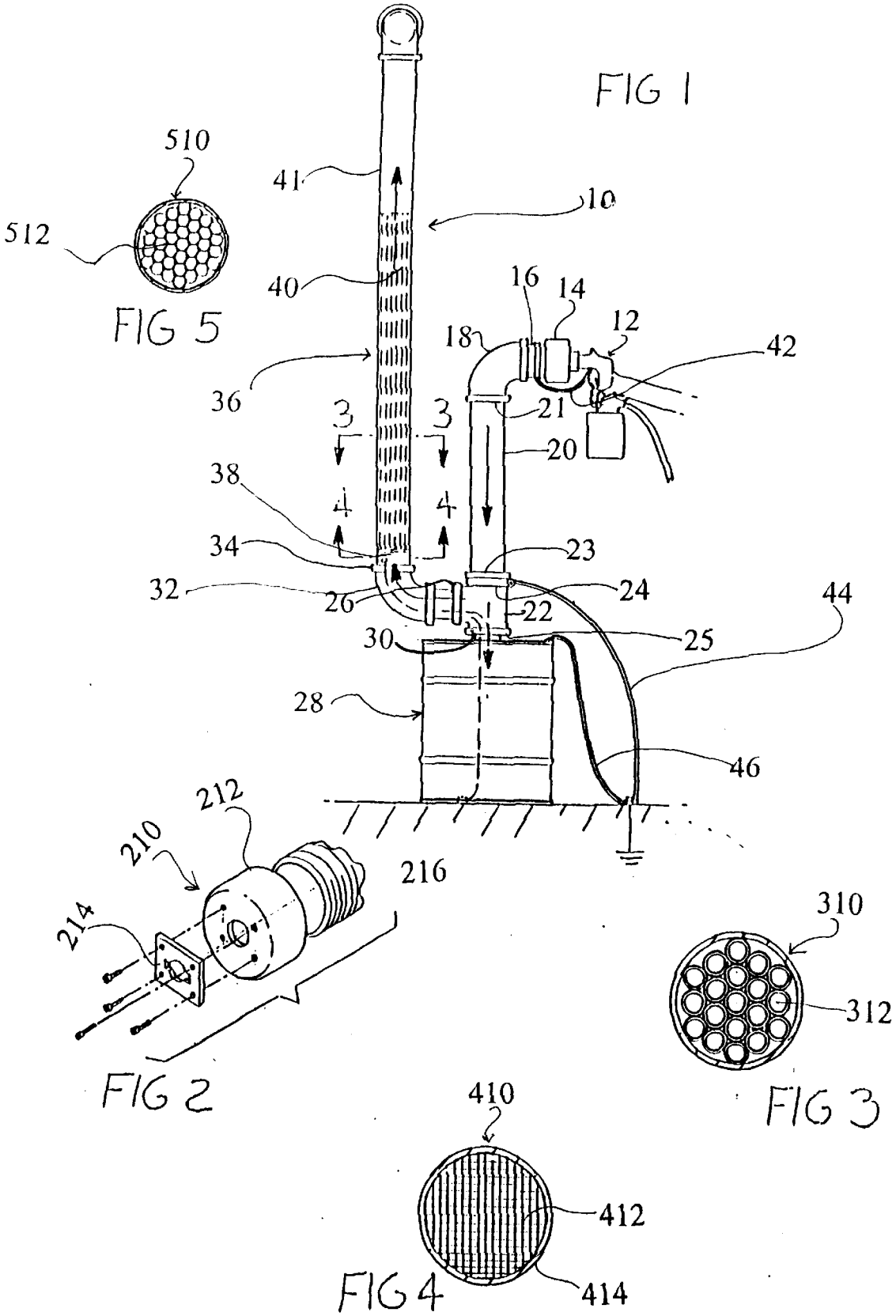
FIG. 1 is an environmental view of a preferred embodiment of the spray gun cleaning device of the present invention.
FIG. 2 is a cross sectional view of a preferred embodiment of a gun coupler for use with the device of FIG. 1.
FIG. 3 is a cross sectional view illustrating a preferred embodiment of a condenser for use with the device of FIG. 1.
FIG. 4 is a cross sectional view of a preferred embodiment of a holder that provides support for the condenser pipes in the condenser of FIG. 3.
FIG. 5 is a cross sectional view of a preferred embodiment of a condenser for use with the device of FIG. 1.

The spray gun cleaning apparatus of the invention is designed to work with siphon-fed spray guns or pressure pot spray guns, or other spray guns of similar dimensions. Such spray guns typically use air pressure both to force a stream of paint out of the spray gun and to atomize the stream in order to break it up into a mist of small droplets. The atomization may be accomplished by means of an air cap at the outlet for the paint. Air caps come in many different configurations, but typically may include openings on flanges that protrude from the air cap on either side of a center nozzle for the paint stream. Typically, the material sprayed from the spray gun will be traveling at a velocity of 800 to 1000 ft/sec. Cleaning solvent is likewise forced through the spray gun and atomized into a mist by the compressed air.

A spray gun cleaning device for capturing and condensing sprayed cleaning solvent, according to the present invention comprises a passage way having an inlet which receives a spray gun nozzle. Preferably, the receptacle is a gasket and endcap. The gasket is molded to form a tight seal with the spray gun. The endcap connects to a vertically descending tubular member having proximal and distal openings, at its proximal opening. In the preferred embodiment the endcap attaches to the descending tubular member via a nipple and descending elbow connector. The vertically descending member attaches directly or via one or more connecting members to a waste collection container at its distal opening downstream of its proximal opening. The vertically descending tubular member may comprise more than one component. The vertically descending tubular member attaches to a vertically ascending passive condenser at its second distal opening, and at a 90° angle from the first distal opening. One or more connectors may be used to connect the vertically descending member to the ascending condenser. The ascending condenser comprises a multiplicity of tubular members located adjacent to one another. The multiplicity of tubular members are supported within the condenser by a perforated holder.

A preferred embodiment of the present invention is shown in FIG. 1. The gun cleaning device 10 as shown in FIG. 1 receives a paint spray gun 12, which fits snugly into a gun coupler 14. The gun coupler is shown in more detail in FIG. 2, and is further discussed below. The gun coupler 14 is connected to a passage way for transfer of the air stream containing the wash solvent fluids from the spray gun through the apparatus. "Air stream" is used throughout to indicate a stream of air and wash solvent fluids and may contain paint or paint residue from the spray gun. The passage way in the preferred embodiment comprises a horizontal member 16, connected to a descending elbow member 18. The horizontal member is preferably a nipple which is 4 inches to 6 inches in length. The elbow 18 is connected to a descending vertical tubular member 20.

Preferably, the vertical tubular member 20 is 24 inches to 36 inches in length. The descending vertical tubular member 20 comprises proximal and distal openings 21 and 23 respectively, and connects via its distal opening 23 to a tee 22. The tee 22 has three openings. A first tee opening 24 connects to the descending tubular member at the tubular member's distal opening 23. A second tee opening 25 located opposite opening 24 is connected to a waste container 28. Preferably, a reducer member 30, such as a 1 inch to 2 inch close nipple, is used as a fitting to make the connection from the tee to the solvent collection container. The solvent container 28 may be of any size, for example it may be of quart, gallon, or drum size. The waste container 28 collects any used wash solvent containing the solvent cleaned from the spray gun. Some preferred containers are steel or plastic quart or gallon cans or jars and standard five-gallons cans that comply with DOT regulations. The containers preferably have lids with openings of suitable size to connect with the reducer member 30, such as threaded 1 inch or 2 inch openings. The fitting into the solvent collection container must be air tight and slightly pressure resistant (up to 3 psi). Preferably, the solvent collection container is attached by a means that allows the container to be easily removed for emptying. A cam lock connector can be used to attach the container to the solvent removal system. Alternatively, the collected solvent could be removed from the solvent collection container via a second opening in the container by pumping, suctioning, pressurized removal, or draining from the bottom of the container.

A third tee member opening 26 is located perpendicular to opening 25. The opening 26 feeds the air stream from the vertical tubular member into the condenser 36. The opening 26 is fitted to a vertically ascending elbow 32. Preferably, the connection between the horizontal port 26 of the tee and the vertically ascending elbow 32 is accomplished by means of a 4 inch to 6 inch nipple 34. Preferably, the nipple is a 6 inch nipple. The vertically ascending elbow 32 leads into a vapor condensation system, having a condenser 36 comprising a tubular member having a diameter of between 4 inches and 6 inches and no less than three feet in length, preferably three to four feet in length. The condenser provides a passive means for separating solvent vapors and waste material from the air stream.

The condenser 36 comprises a housing 41 which surrounds a multiplicity of tubular members 40 of a diameter between ½ inch and 1 inch, and between two feet and three feet long. The tubes are arranged adjacent to one another, preferably in a circular fashion, as shown in FIG. 3 or 5. Any space between the tubes is left open to increase the maximum surface area of the tubes to increase the condensing effect of the tubes on the the air flow from the vertically descending tubular member. Solid copper rods could also be used as the condensing tubes but the number required would dramatically increase. The housing 41 may be of any suitable material, such as metal or plastic. Optimum lengths for the condensing tubes 40 are between 24 inches and 30 inches. The condenser tubes are further illustrated in FIG. 3. Preferably, the condensing tubes 40 comprise a thermally conductive, solvent-resistant material such as copper, aluminum, steel, and manganese. Copper is preferred due to its excellent thermal conductivity and heat/cooling conduction. The condenser 36 may also be jacketed with a cooling jacket (not shown) to lower the ambient temperature, to further precipitate the solvent. The multiplicity of tubular members is supported at a juncture with the vertically ascending elbow 32 and the condenser 36, by means of a perforated holder 38. The holder 38 is secured inside the condenser 36 within a short distance from the bottom end of the condenser, preferably, within 3 inches of the bottom end of the condenser, using suitable means. Such suitable means for securing the holder may include welding, friction fit, or use of a collar or gasket to support the holder. Exterior bolts are not preferred because of the difficulty in keeping the apparatus air-tight when bolts are used. The condenser 36 is left open at the top for venting. The exhaust can be redirected, for example into a building exhaust plenum (not shown), by means of an appropriately directed elbow (not shown) or other suitable transitional fitting (not shown). The gun cleaning device can be attached to a wall by bolting or other means suitable to insure stability of the device during operation.

The gun cleaning device 10 preferably is metallic so that the device can be grounded to prevent build up of static electricity and discharge of sparks. A metal device is grounded by attaching ground wires or grounding strap to the gun cleaning device at any point. An earth ground is preferred over an electrical ground. In a preferred embodiment, as shown in FIG. 1, a first ground wire 42 is attached from the gun to the cleaning device. A second earth ground wire 44 is attached to the device at the point where the descending vertical member 20, connects to the tee 22. A third ground wire 46 is attached to the waste collection container and to an earth ground. A plastic device can also be grounded by running a ground wire through the interior of the entire device or by an internal grounding strap or wire. The ground wire for either a metallic or plastic device is preferably #8 gage copper wire.

The spray gun cleaning device is constructed of tubular elements, preferably of uniform diameter. Preferably, the device is constructed using readily-available piping, such as piping with diameter of 4 inches or 6 inches. Maximum diameter improves efficiency, but larger diameters are more obtrusive in the spraybooth where cleaning is most conveniently done. Pipe wall thickness is preferably 1/16 inch to 1/4 inch.

The gun cleaning device is constructed of a material resistant to the paint solvents expected to be used with the apparatus. The diversity of solvents that may be encountered with various paint systems may be represented by methyl ethyl ketone, xylene, and water. Some materials from which the gun cleaning device could be fashioned may be suitable for some solvents but not for others. For example, the device can be constructed from mild steel or aluminum if no water will be used in the gun cleaning process. On the other hand, some plastics may be suitable in connection with waterborne paint that clean up with water but not with organic cleaning solvents such as xylene or methyl ethyl ketone. Metals such as stainless steel, galvanized steel, copper, and brass, and solvent-resistant plastics such as fiberglass, graphite composites, carbon fibered plastics, and polycarbonates are preferred materials for the device because they can be used with a wide variety of cleaning solvents without corroding. Among these, stainless steel is particularly preferred, and stainless steel piping appropriate for use as various elements of the device is readily available commercially. Alternatively, materials that would not otherwise be suitable for use with a particular cleaning solvent may be coated with a barrier coating to prevent corrosion. For example, a mild steel part may be coated with a moisture-resistant barrier of an epoxy coating to prevent rusting.

The elements of the apparatus may be fitted together by a variety of means, including pipe threaded, welded, soldered, friction fit, clamped (e.g., cherry-berril), or, in the cases of plastic pipes, chemically bonded. The joint where the elements meet must be air-tight and slightly pressure-resistant (up to 3 psi). In one preferred embodiment, the elements are standard schedule 40 pipe-threaded units. Where pipe sealant is used, the sealant should not hinder the pipe's electrical conductivity.

Referring to FIG. 2, there is shown in detail a gun coupler 210 formed from a large endcap 212 and a gasket 214. The gasket 214 is contoured to accommodate the nozzle of the spray gun. The gasket 214 is constructed to allow the spray gun to mount securely and with a snug fit. The endcap 212 connects to an inlet 216 of the spray gun cleaning device. The endcap 212 is constructed of the same kinds of materials described previously for the apparatus in general. Metals such as stainless steel, galvanized steel, copper, and brass, and solvent-resistant plastics such as fiberglass, graphite composites, carbon fibered plastics, and polycarbonates are preferred materials for the endcap because they can be used with a wide variety of cleaning solvents without corroding. Among these, stainless steel is particularly preferred.

The gasket 214 is firmly attached to the face of the gun coupler by suitable means, such as gluing, clamping, or, preferably, bolting onto the face of the gun coupler. An example of a typical spray gun used with the present invention is a Binks Model 66 spray gun. The invention is not limited to this spray gun and may also include any spray gun, pressure pots or other paint atomizing equipment. The shape of the center opening of the gasket will vary, depending upon the shape of the air cap and nozzle of the gun with which it is used. The gasket is constructed of a material suitable for use with the cleaning solvents that will be used. Preferably, the gasket is constructed of solvent resistant rubber, nylon, Teflon, or polycarbonate. Rubber is particularly preferred. The thickness of the gasket may be varied to optimize the seal in reference to the air cap seal requirements. This gasket will be thicker if the air cap is longer or deeper. Where the flanges of the air cap are more angled, the gasket must be made thicker. The gasket is preferably 1/4" to 3/8" thick.

FIG. 3 illustrates a cross section of the condenser portion of the spray gun cleaning device. In a preferred embodiment the condenser 310 is filled with a close packing arrangement of condensing tubes 312. FIG. 3 and FIG. 5 illustrate preferred embodiments of the condenser. FIG. 3 illustrates an arrangement of about 19 condensing tubes inside of the condenser. Such an arrangement is achieved, for example, by using a 4 inch inner diameter pipe as the condenser and 3/4 inch inner diameter condensing tubes. FIG. 5 illustrates a condenser 510 using 37 condensing tubes 512. This arrangement is accomplished with 6 inch inner diameter pipe as the condenser and 3/4 inch inner diameter condensing tubes.

FIG. 4 illustrates a holder 410 for supporting the condensing tubes. The holder 410 is, for example, a metal or plastic screen or grid 412, surrounded by a supporting ring 414. The grid may be fastened to, or integral with the supporting ring.

Solvent is separated from the air stream in the condenser by the condensation or precipitation that occurs in the device when the atomized solvent is forced through the condensing tubes 40. The velocity of the air flow is reduced by changing direction of the air stream and by forcing the air stream through the condensing tubes, as the condensing tubes are of a much smaller diameter (1/2 to 1 inch) in comparison to the diameter of the vertical tubular member (4 to 6 inches). The velocity of the air flow, originally 800 to 1000 ft/sec, is attenuated to about 15 to 25 ft/sec. Air passing through the condensing tubes 40 creates both back pressure and laminar air flow. These factors cause the solvent to condense and large solvent droplets greater in density than the updraft air mass/velocity are collected by gravity in the waste collection container. Vaporized solvent flows through the condenser causing a passive cooling due to solvent evaporation. The cooling effect causes vaporized solvent to further condense forming liquid solvent droplets which flow by gravity to the waste collection center.

A method for using a spray gun cleaning device comprises the steps of first inserting the spray gun nozzle into the spray gun receptacle. Solvent is fed into the spray gun through the gun cup or a feed line. The solvent is then discharged through the spray gun nozzle and into the spray gun cleaning device. An air stream containing atomized solvent, paint and air, flows by means of gravity through the descending vertical tubular member and into the ascending tubular members comprising the condenser. The solvent is precipitated as described in the preceding paragraph. The liquid solvent and paint waste are discharged into the waste collection container through the opening in the tee member.

I have described, in accordance with the present invention, a method and apparatus for cleaning spray guns wherein the aspirated cleaning solvent is captured and condensed. While the invention has been described in conjunction with specific preferred embodiments, it is intended to embrace any and all alternatives, variations, and modifications that fall within the spirit and broad scope of the appended claims.

I claim:

1. A spray gun cleaning device for capturing and condensing sprayed cleaning solvent, comprising:

(a) a passage way comprising an inlet and an outlet, wherein said inlet defines a receptacle for receiving a spray gun nozzle, (b) a vertically descending member having a proximal opening and first and second distal openings, wherein the first distal opening is located downstream from the proximal opening and at a 90° angle to the second distal opening, and wherein the descending member is connected to the passage way outlet at its proximal opening, (c) a waste collection container located downstream of the vertically descending member, and connected to the first distal opening of the vertically descending member, (d) a vertically ascending passive condenser attached to the vertically descending member at its second distal opening, wherein the condenser comprises a multiplicity of tubular members located adjacent to one another.

2. Device according to claim 1 wherein the vertically descending member comprises i) a tubular member having proximal and distal openings, its proximal opening connected to the passage way outlet, and ii) a tee member having three openings comprising first and second openings disposed opposite one another, and a third opening perpendicular to the first and second openings, wherein the first opening connects to distal end of the tubular member, the second opening connects with a waste collection container and the third opening connects to the condenser.

3. Device according to claim 2 wherein the passage way is a horizontally oriented passage way.

4. Device according to claim 3 wherein the passage way is a nipple ranging from 4 to 6 inches in length.

5. Device according to claim 3 further comprising a descending elbow connector for attaching the passage way at its outlet, to the vertically descending tubular member.

6. Device according to claim 5 further comprising an ascending elbow member for connecting the tee member via its perpendicular opening to the ascending vertical member.

7. Device according to claim 6 further comprising a nipple connector to connect the third opening of the tee member to the ascending elbow member.

8. Device according to claim 2 further comprising a reducer member fitting to connect the tee member to the waste collection container.

9. Device according to claim 2 wherein the vertically descending member measures between 24 and 36 inches in length.

10. Device according to claim 1 wherein the condenser measures at least 36 inches in length.

11. Device according to claim 1 wherein the condenser measures between 36 and 48 inches in length.

12. Device according to claim 1 wherein the condenser contains between 15 and 40 condensing tubes.

13. Device according to claim 1 wherein the condenser contains 37 to 38 condensing tubes.

14. Device according to claim 1 wherein the condenser contains 19 condensing tubes.

15. Device according to claim 1 wherein the condensing tubes measure between 24 and 36 inches in length.

16. Device according to claim 1 further comprising a perforated holder located inside the condenser for supporting the condensing tubes.

17. Device according to claim 1 further comprising a cooling jacket covering the condenser.

18. Device according to claim 1 wherein the receptacle for receiving a spray gun nozzle comprises a gasket contoured to accommodate a nozzle of a spray gun and an endcap which is connected to the passage way of the device.

19. A method for using a spray gun cleaning device according to claim 1 comprising the steps of a) inserting the spray gun nozzle into the spray gun receptacle, b) feeding solvent into the spray gun, c) discharging the solvent through the spray gun nozzle, d) allowing an air stream containing atomized solvent, paint and air, to flow by means of gravity through the descending vertical tubular member and into the ascending tubular member, e) allowing the air stream containing precipitated solvent to flow by means of back pressure and gravity, downward through the ascending tubular member into the tee member and finally into the waste collection container.

20. A spray gun cleaning device for capturing and condensing sprayed cleaning solvent, comprising:

(a) Passage way comprising i) a receptacle for receiving a spray gun nozzle, ii) a connecting member attached to the receptacle and a descending elbow attached to the connecting member, (b) a vertically descending member comprising a tubular member having a proximal opening end connected to the descending elbow and a distal opening, and a tee member having first and second vertical ports disposed opposite one another, wherein the first vertical port connects to distal end of the tubular member (c) a waste collection container connected to the vertical port of the tee member, (d) a vertically ascending passive condenser attached to the vertically descending member via an ascending elbow, wherein the condenser comprises a multiplicity of tubular members located adjacent to one another.

* * * * *